United States Patent [19]

Hirose et al.

[11] Patent Number: 4,869,849

[45] Date of Patent: Sep. 26, 1989

[54] FLUID MIXING APPARATUS

[75] Inventors: Joji Hirose, Tokyo; Akira Uchida, Yukosuka, both of Japan

[73] Assignee: Chugoku Kayaku Kabushiki Kaisha, Shioya, Japan

[21] Appl. No.: 113,630

[22] Filed: Oct. 27, 1987

[30] Foreign Application Priority Data

Apr. 10, 1987 [JP] Japan ..... 62-89604

[51] Int. Cl.[4] ..... B01F 3/04

[52] U.S. Cl. ..... 261/78.2; 366/340; 261/DIG. 26

[58] Field of Search ..... 366/340; 261/78.2, DIG. 26

[56] References Cited

U.S. PATENT DOCUMENTS

| | | | |
|---|---|---|---|
| 2,125,245 | 7/1938 | McCray | 366/340 |
| 3,045,984 | 7/1962 | Cochran | 366/340 |
| 3,377,139 | 4/1968 | MacGregor et al. | 261/DIG. 26 |
| 3,388,868 | 6/1968 | Watson et al. | 261/DIG. 26 |
| 3,582,048 | 6/1971 | Sarem | 366/340 |
| 3,593,964 | 11/1968 | Morane | 366/340 |
| 4,068,830 | 1/1978 | Gray | 366/340 |
| 4,396,529 | 8/1983 | Price et al. | 261/DIG. 26 |

FOREIGN PATENT DOCUMENTS 58-2062 1/1983 Japan .

*Primary Examiner*—Tim Miles

*Attorney, Agent, or Firm*—Marshall, O'Toole, Gerstein, Murray & Bicknell

[57] ABSTRACT

A fluid mixing apparatus is provided in which pressure plates and collection plates are stacked alternately, with cavities between, the pressure plates each having an annular band of fine flow holes while the collection plates each have one or a small number of comparatively large flow-holes eccentrically disposed in relation to the center of the plate. The cavities between the plates can be provided by depressions formed in both faces of each collection plate. The pressure plates can each advantageously comprise a mesh or screen structure to provide the fine flow-holes.

4 Claims, 2 Drawing Sheets

FLUID MIXING APPARATUS

This invention relates to a fluid mixing apparatus capable of being used for mixing two liquid phases, or a liquid phase and a gaseous phase, or two gaseous phases, such as, for example, an apparatus for producing an emulsion obtained by mixing an oil phase and a liquid phase.

Although there are numerous types of mixing apparatus and these are used in a wide variety of applications, in addition to the existing types, new apparatus are constantly being proposed and developed. One of these is the apparatus described in Japanese Patent Publication 58-2062 published Jan. 13, 1983.

This apparatus was constructed in such a manner that inside a nozzle body were stacked alternating circular disc-shaped pressure plates and circular disc-shaped collection plates, each pressure plate having many tiny holes formed at appropriate intervals in the circumferential direction adjacent to its periphery, and each collection plate having concave depressions formed on both its upper and lower faces and a large-diameter hole formed in its center. Although this apparatus was able to provide somewhat increased effectiveness for the mixing of substances such as two-part curing resins, where the curing agent would have a certain amount of inherent dispersability with respect to the base agent, it did not have sufficient performance to be used as an apparatus for the production of an emulsion.

We believe the reason why the apparatus described above is not suitable for use as an apparatus for the production of an emulsion can be attributed to the fact that, although there is a large shear force and the fluids are subjected to a strong blending action when they flow through the tiny holes in the pressure plates, because the flow of the fluids at the concave depressions formed in the upper and lower faces of the collection plates is relatively smooth, the overall mixing is insufficient.

An object of this invention is to achieve a mixing apparatus capable of performing a much improved mixing action.

According to the present invention, there is provided a fluid mixing apparatus wherein inside a cylindrical body are stacked pressure plates, having many tiny flow holes distributed around each plate, alternating with collection plates, having through-holes for fluid flow that are large in comparison to the tiny holes in the pressure plates, with cavities provided between the plates of the two types, characterised in that each collection plate has one or more of said comparatively large flow holes at a location or locations that are eccentrically disposed with respect to the centre of the plate.

Here, although the collection plates can be stacked alternately with the pressure plates in such a manner that the positions of the eccentric holes are aligned plate to plate, it is preferred that they be stacked in random angular orientation so that the positions of the eccentric holes are not aligned.

Although it is possible for the cavities to be formed by ring-shaped spacers placed between the two types of plates, it is preferred that they be formed by concave recesses in the faces of at least one of the two types of plates.

According to a preferred aspect of the invention, the pressure plates each comprise a mesh or screen structure to provide the tiny flow-holes.

Although it is possible for the pressure plates to be comprised of only the mesh structure, it is preferred that they be comprised of mesh structure and a dish-like holding plate provided with an appropriate number of through-holes and into which the mesh structure is fitted.

For the mesh structure, although a metal screen can be used as a representative preferred example, non-woven fabric can also be used, and, if the material used is flexible, it can be secured in the holding plate by adhesion or some other method.

Note that, if the pressure plates are comprised of only the mesh structure, although it is possible to use either a single layer or multiple layers of mesh stacked one upon another, in either case it is preferred that the periphery be secured in a circular holder or wrapped in teflon tape or something similar in order to form a packing so that, when the pressure plates are stacked inside the body, the space between each pressure plate and the body is sealed.

Arrangements according to the invention will now be described by way of example and with reference to the accompanying drawings in which.

Figures 1, 2A, 2B, 3A, 3B:
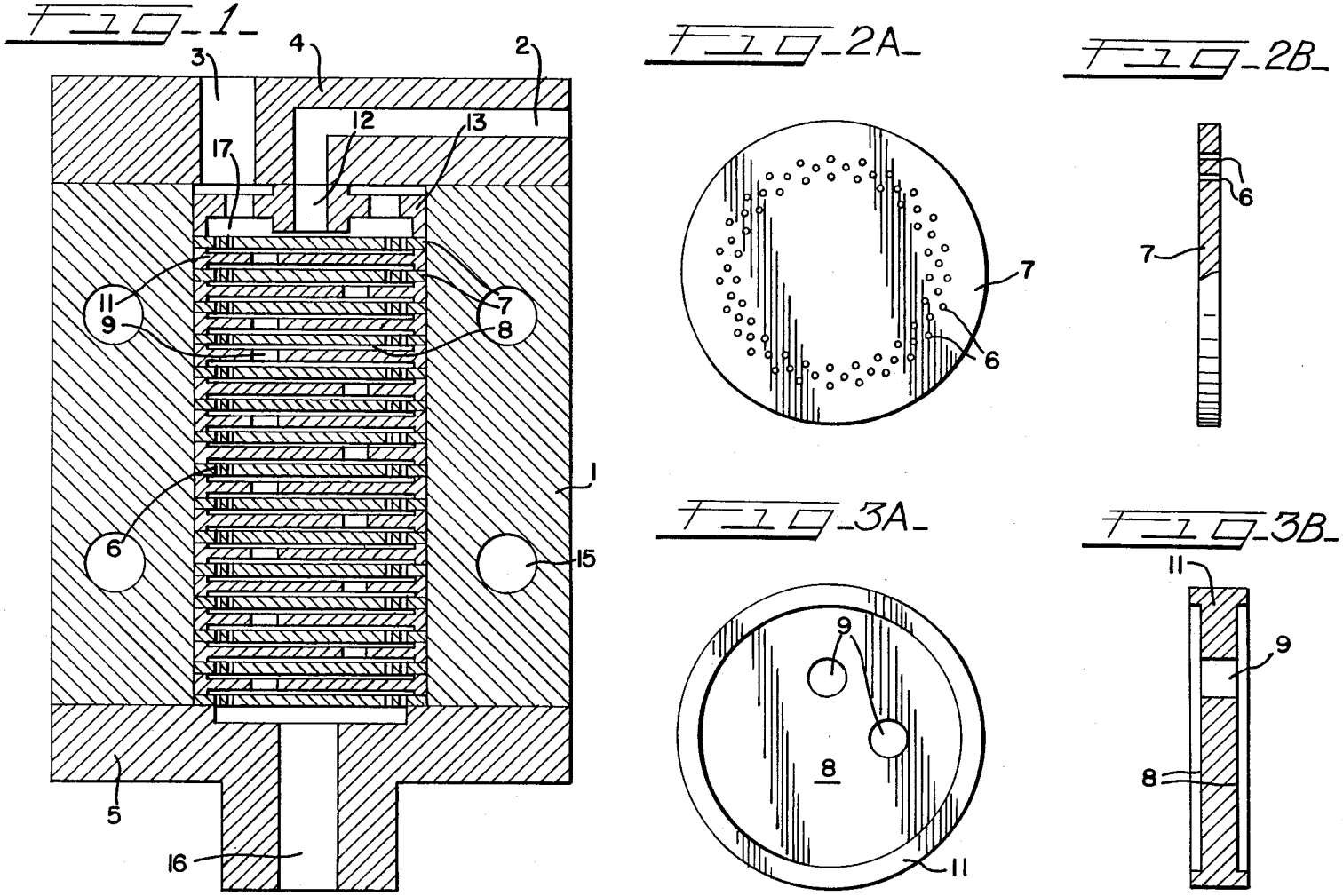
FIG. 1 shows a cross-sectional view of a mixing apparatus of this invention.
FIG. 2A shows a plan view of a pressure plate such as those shown in FIG. 1.
FIG. 2B shows a side view partially in cross section of the pressure plate shown in FIG. 2A.
FIG. 3A shows a plan view of a collection plate such as those shown in FIG. 1.
FIG. 3B shows a cross-sectional view as seen along line A—A in FIG. 3A.

Referring firstly to FIG. 1, a top cover 4 having inlets 2 and 3 and a bottom cover 5 shaped like a flanged pipe are mounted onto the cylindrical body 1. Circular disc-shaped pressure plates 7, in which, as shown in FIGS. 2A and 2B, many tiny holes 6 are formed in a generally annular band around the plate, and collection plates 11, in which, as shown in FIGS. 3A and 3B, concave depressions 8 are formed in both faces and eccentric holes 9 are formed at two locations, are alternately fitted inside the cylindrical body 1 in a closed stack in random angular orientation so that the positions of the eccentric holes 9 are not aligned. An axially flanged plate 13 having multiple through-holes 12 arranged one at its center and the rest in a ring around the centre is also fitted into the cylindrical body 1 at the top of the stack. In FIG. 1, 15 are passages for a cooling medium or heating medium through the body 1 for use in cases where temperature adjustments are necessary, and 16 is a discharge port through the bottom cover 5. In this instance the eccentric holes 9 are unsymmetrical with respect to the centre of the plate. A fluid forced in through the inlet 2 at the necessary pressure passes through the through-hole 12 in the center of the flanged plate 13 and spreads out inside a cavity 17 formed within the flange on the plate. At the same time, a second fluid forced in through the inlet 3 flows into the cavity 17 through the ring of holes in the plate 13 and mixes with the first fluid. Then, the two fluids are forced through the tiny holes 6 in the first pressure plate 7 and are here subjected to a strong shearing action.

Although the fluid coming out of each tiny hole 6 is under approximately the same pressure and flowing at approximately the same speed, both the pressure and the flow speed are higher than those of the fluid inside the cavity 17, and it is in this state that the fluid comes in contact with the bottom of the concave depression 8 in the following collection plate 11. The fluids coming in contact with the bottom of the concave depression are subjected to a repeat combining action, both the pressure and the flow speed dropping and becoming approximately the same as those of the fluids within the cavity 17.

Figure 4:
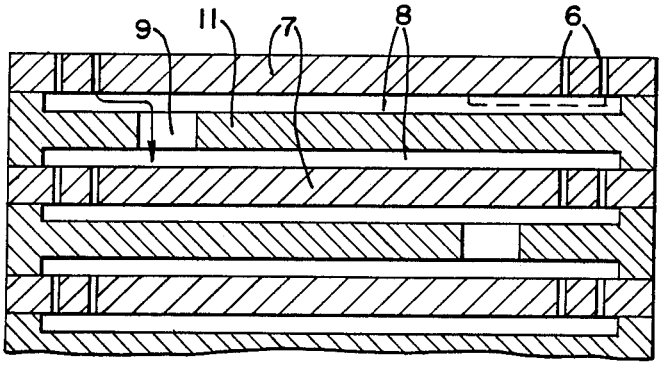
FIG. 4 shows an expanded view of a part of FIG. 1.

The mixed fluid next passes through the eccentric holes 9 in the collection plate 11 and flows to the concave depression 8 on the opposite side. However, of the fluid which simultaneously flowed through the tiny holes 6, the portions which were closest to the eccentric holes 9 reach the bottom of the next concave depression at a time when the portions that were farthest from the eccentric holes have only reached, for example, the position indicated by the broken arrowed line in FIG. 4. Therefore, as the fluid that has passed through the plate 7 at distances further and further from the eccentric holes 9 progressively reaches the bottom of the concave depression 8 at the far side of the plate 11, it flows into fluid that was closer to the eccentric holes and therefore has already arrived, thus creating eddies and causing a combining and shearing action to be applied. Then, the fluid is forced through the tiny holes 6 of the next pressure plate 7 and once again a strong shear force is applied.

In the embodiment described above, the pressure plate used is one which has many tiny holes formed in its area. However, it is also possible to use a metal screen as the pressure plate.

Figure 5:
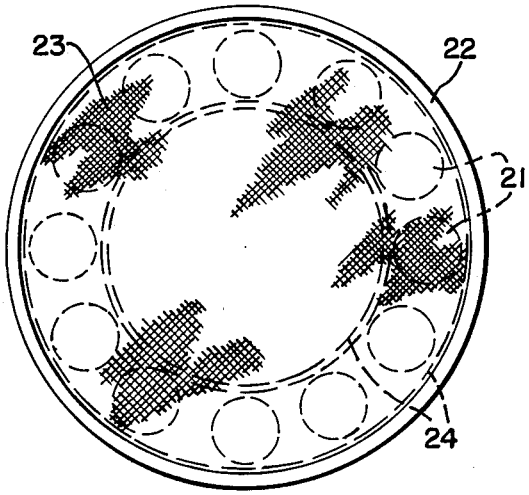
FIG. 5 shows a bottom view of another example of a pressure plate.
Figure 6:
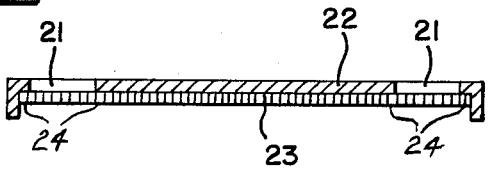
FIG. 6 shows a cross-sectional view of the pressure plate shown in FIG. 5.

FIGS. 5 and 6 show one example of this type of pressure plate. The pressure plate is comprised of a dish-like holding plate 22, near the periphery of which are formed a ring of through-holes 21 spaced at equal intervals, and a large-mesh metal screen 23 which is fitted into the holding plate. The metal screen is secured by fusion, adhesion, or any other appropriate method to the holding plate 22 around rings 24 disposed radially immediately at the inside and the outside of the ring of through-holes 21.

The reason why the metal screen is secured in this manner is so that the fluid will flow only through the annular band between the rings 24, and more particularly through the parts of the metal screen which directly cover the through-holes 21. For this reason, it is also preferred that the metal screen be secured by fusion or some other method to the holding plate in the areas surrounding the through-holes 21.

Figure 7:
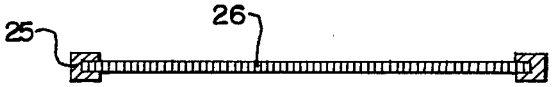
FIG. 7 shows a cross-sectional view of another example of a pressure plate.

FIG. 7 shows an example of a pressure plate comprised of a metal screen 26 stretched inside a circular holder 25.

Thus, the arrangements described provide a mixing device in which pressure plates and collection plates are stacked alternately, and in which the flow holes formed in the collection plates are eccentric. With this construction, in addition to the blending action caused by the pressure plates, a further blending action results from the shifting phases of the fluid due to the eccentricity of the holes in the collection plates, thus making possible the easy and continuous production of not only various emulsions, but also of other blended mixtures of two liquid phases, a liquid phase and a gaseous phase, or two gaseous phases. Therefore, the invention has wide application in mixing and blending processes.

The second important improvement is in the use of a mesh structure, such as a wire screen, for the pressure plates. With this construction, in comparison to one which requires a manufacturing procedure for making the many tiny holes in the metal plates, the fabrication of the pressure plates can be done more easily and at lower cost, it is possible to fabricate the pressure plates to any desired thickness, and it is possible to use a material which is not easily subject to corrosion, or any other appropriate material, without being effectively limited to aluminium.

Furthermore, because the number of holes per plate can be changed, by attaching a cover (e.g., dish-like holding plate 22) having large apertures of an appropriate size formed in it, and then replacing this cover with other covers having different numbers of apertures or different size apertures, it is possible to control the flow volume across a wide range. In addition, in comparison with pierced holes, because the flow paths are formed by the combination of the wires in the screen, the flow paths are varied rather than being uniform, thus creating eddies and causing a strong shearing action to be applied to the fluid.

There now follows an account of actual results achieved with reference to two examples.

EXAMPLE 1

The mixing apparatus employed was generally in accordance with FIG. 1, having circular disc-shaped pressure plates around which were formed 100 0.15-mm diameter holes, and collection plates with concave depressions in both faces and two 1.5-mm, diameter flow holes formed at two eccentric locations. The collection plates were randomly angularly orientated so that the positions of the eccentric holes were not aligned. The temperature inside the cylindrical body was controlled to 90° C. by introducing an oil heating medium oil into the passages designed for that purpose.

Fluid 1 (oil phase), consisting of wax and emulsifying agent and having a temperature of 90° C., and Fluid 2 (water phase), consisting of nitrates and water and having a temperature of 90° C., were simultaneously introduced into the mixing apparatus through inlet 2 and inlet 3, respectively, at flow volumes of 33 $mm^3/S$ and 390 $mm^3/S$, respectively. After passage through the mixing apparatus the mixed fluids were discharged from the discharge port as a water-drops-in-oil type emulsion.

When this emulsion was observed using an electron microscope, the diameters of 500 drops were measured, and the arithmetical average was calculated, it was found that the average particle diameter was 1.11$\mu$. This average particle diameter is a parameter for evaluating the strength of the shearing action; the smaller the average particle diameter, the stronger the shearing action.

The experiment was repeated using different numbers of plates, different numbers and sizes of holes in the pressure plates and different flow rates. The results are shown in Table 1.

TABLE 1

| | | | | | | | | | | | | | | | | | | | | | | |
|---|---|---|---|---|---|---|---|---|---|---|---|---|---|---|---|---|---|---|---|---|---|---|
| Pressure Plates | | | | | | | | | | | | | | | | | | | | | | |
| Hole diameter | | 0.1 mm | | | | 0.15 mm | | | 0.2 mm | | | 0.3 mm | | 0.15 mm | | | | | 0.2 mm | | 0.15 mm | |
| Number of holes | | 240 | | | | 100 | | | 60 | | | 27 | | 100 | | | | | 60 | | 100 | |
| Collection Plates | | | | | | | | | | | | | | | | | | | | | | |
| Hole diameter | | | | | | | | | | | | 1.5 mm | | | | | | | | | | |
| Number of holes | | | | | | | | | | | | 2 | | | | | | | | | | |
| Number of each type of plate | | | | | | 20 | | | | | | | | 25 | | | 30 | | | 20 (0.2 mm) 20 (0.15 mm) 40 in all | | |
| Flow volume ($mm^3/s$) | Fluid 1 (oil phase) | 11 | 22 | 33 | 44 | 11 | 22 | 33 | 22 | 33 | 44 | 22 | 22 | 33 | 44 | 11 | 22 | 33 | 11 | 22 | 33 | 44 |
| | Fluid 2 (water phase) | 130 | 260 | 390 | 520 | 130 | 260 | 390 | 260 | 390 | 520 | 260 | 260 | 390 | 520 | 130 | 260 | 390 | 130 | 260 | 390 | 520 |
| Average particle size ($\mu m$) | | 1.27 | 1.17 | 1.03 | 1.02 | 1.78 | 1.81 | 1.11 | 1.49 | 1.29 | 1.09 | 2.56 | 1.04 | 1.06 | 1.11 | 1.79 | 1.17 | 0.88 | 1.62 | 1.56 | 1.46 | 0.99 |

EXAMPLE 2

The pressure plates in this case were each comprised of a holding plate, in which were formed at equal intervals in a ring near the periphery 16 1-mm diameter holes, and a 40-μm mesh metal screen which was secured to the holding plate by adhesion. The mixing apparatus contained a stack of 20 of these pressure plates alternating with 20 collection plates, in which latter two 1.5-mm diameter holes were formed at eccentric locations.

As in Example 1, Fluid 1 and Fluid 2 were introduced into the mixing apparatus at flow volumes of 11 $mm^3/s$ and 130 $mm^3/s$, respectively, and a water-drops-in-oil type emulsion was obtained. The average particle diameter of this emulsion was 1.12 μm.

We claim:

1. A fluid mixing apparatus wherein inside a cylindrical body are stacked pressure plates, having many tiny flow holes distributed around each plate, alternating with collection plates, having through-holes for fluid flow that are large in comparison to the tiny holes in the pressure plates, with cavities provided between the plates of the two types, characterised in that said holes in said pressure plates have a diameter in the range of 0.1 to 0.3 mm, each collection plate has one or more of said comparatively large flow holes at a location or locations that are eccentrically disposed with respect to the centre of the plate, and none of said holes in said pressure plates are axially aligned with said holes in said collection plates.

2. An apparatus according to claim 1, wherein the cavities between the plates are formed by concave depressions in the plates of one type.

3. An apparatus according to claim 2, wherein the depressions formed are in both faces of the collection plates.

4. An apparatus according to any preceding claim, wherein the collection plates are randomly angularly orientated so that the eccentric flow-holes in successive plates are not aligned with one another.

* * * * *